US006351905B1

(12) United States Patent
Dean

(10) Patent No.: US 6,351,905 B1
(45) Date of Patent: Mar. 5, 2002

(54) COMMEMORATIVE BOOK TILES

(75) Inventor: Danny R. Dean, Carmel, IN (US)

(73) Assignee: Indianapolis-Marion County Public Library, Indianapolis, IN (US)

( * ) Notice: Subject to any disclaimer, the term of this patent is extended or adjusted under 35 U.S.C. 154(b) by 0 days.

(21) Appl. No.: 09/587,701

(22) Filed: Jun. 5, 2000

(51) Int. Cl.[7] ..... A47G 1/06

(52) U.S. Cl. ..... 40/800; 40/124.5; 40/411; D11/131; D11/184

(58) Field of Search ..... 40/124.5, 411, 40/800; D11/131, 132, 184

(56) References Cited

U.S. PATENT DOCUMENTS 4,584,213 A * 4/1986 Rentowl ..... 428/23
D359,255 S * 6/1995 Williams ..... D11/132
5,909,794 A * 6/1999 Molbak et al. ..... 194/216
6,052,674 A * 4/2000 Zervides et al. ..... 705/40
6,168,156 B1 * 1/2001 Gonzalez ..... 273/148 A

* cited by examiner

*Primary Examiner*—Christopher P. Schwartz
(74) *Attorney, Agent, or Firm*—Baker & Daniels

(57) ABSTRACT

A system for providing recognition to donors includes a plurality of tiles configured to simulate the appearance of book spines. Each of the tiles carries the name of a particular donor. Certain tiles can also include a medallion signifying special information about the donor or donation. A plurality of tiles are mounted within a frame that simulates a shelf of a bookshelf. The tiles can be formed of ceramic, and the frame of wood, with the tiles attached to the frame by way of a suitable adhesive. In one embodiment, the frame is configured to be mounted on the wall of the donee's building. In another embodiment, the frame is sized to fit snugly within the shelf of a bookshelf so that the commemorative book tiles can be integrated into the environment.

8 Claims, 1 Drawing Sheet

COMMEMORATIVE BOOK TILES

BACKGROUND OF THE INVENTION

The present invention concerns tools and methods for enhancing fund raising efforts. More specifically, the invention relates to commemorative book replicas honoring charitable donors.

Public and private organizations are continually searching for ways to raise money for various projects. Municipal entities, such as public libraries, are particularly in need of charitable contributions from the general public. Organizations of that type usually do not meet their funding requirements from government grants or user's fees. Thus, most public libraries have turned to a variety of fund raising approaches to generate monies for acquiring new books, renovating existing facilities, and even larger capital campaigns.

Naturally, any fund raising campaign relies upon the charitable feelings of its potential donors. Unfortunately, the charitable spirit alone is not always enough to inspire an individual or corporation to make such a contribution. For many years, colleges and universities have been able to rely upon a desire for personal recognition to obtain substantial monetary grants. There is scarcely a university around that does not have a library, dormitory or academic building bearing the name of a past high-dollar donor. In recent years, this approach has been used to finance capital development for public improvements for sports stadiums, theatres and the like.

Unfortunately, most municipal organizations, such as public libraries, do not have the same drawing power that a university or public stadium might have to receive large monetary donations. As a consequence, most fund raising efforts for libraries rely upon medium or small contributions from smaller companies and individuals. A typical capital contribution campaign may depend upon donations from up to a thousand individuals and companies.

With current fund-raising approaches, it has been nearly impossible for municipal organizations and libraries to rely upon the personal recognition aspect of charitable giving to inspire contributions from the general public. One common, yet unsatisfactory, approach has been to simply list the names of donors on a single plaque. While this approach does provide some measure of recognition to the private giver, donor plaques tend to have low visibility and certainly provide no measure of individuality for each donor.

Throughout the years, the sources of the funding for libraries and other similar municipal organizations have been extremely variable. As governments respond to the taxation concerns of its constituents, less and less government money is being made available to assist these types of organizations. Thus, libraries and their counterparts must always rely heavily on the private sector to fund its acquisition and development projects.

As the economy changes, so to does the giving spirit of the public. Consequently, there is always a need for systems and methods to further inspire the general and business public to make donations.

SUMMARY OF THE INVENTION

In order to address this need, the present invention provides an inexpensive yet, highly visible, system and method for providing recognition to individuals and companies making donations. The present invention is best suited for donations to public and private libraries, although the same principals can be applied with equal effect in other organizations seeking public donations.

In one aspect of the invention, commemorative book tiles are provided that are configured to have the appearance of a book spine. The name of the individual or corporate donor is prominently displayed on the book spine. In addition, the spine can include other indicia concerning the donation, such as the year, the status or level of the donation, the donee organization and the like.

In one aspect of the invention, the book tiles are formed of ceramic with only a moderate thickness. The tiles can employ various representations of book spines, having varying heights and thickness dimensions. The character of the tiles can be adjusted to the individual tastes of the donors or donee.

In addition to the commemorative book tiles, the invention contemplates a frame within which the tiles are supported. In one preferred embodiment, the frame can be a representation of one or more shelves of a bookshelf. Like the commemorative book tiles, the frame itself also has a moderate thickness; it need not have the dimensions of a typical bookshelf because it is only housing replicas of the spines of books, rather than the books themselves. Most preferably, the frame is sized to be mounted on a wall of the donee organization.

In one feature, individual frames housing a single row of book tiles can be provided. This single row frame can either be wall mounted, or in a further embodiment can be configured to rest within the shelves of a typical bookshelf. In this latter instance, the commemorative book tiles can be intermingled with actual library books to further enhance the visibility of the donor recognition book tiles.

It is one object of the present invention to provide a system and method for encouraging individuals and companies to make donations. It is a further object to provide a system to prominently recognize these donations.

One benefit of the invention is that it provides a unique and highly visible medium for recognizing donors. Another benefit is that the invention can be readily integrated into the surroundings or décor of the particular donee organization.

DESCRIPTION OF THE PREFERRED EMBODIMENTS

Figure 1:
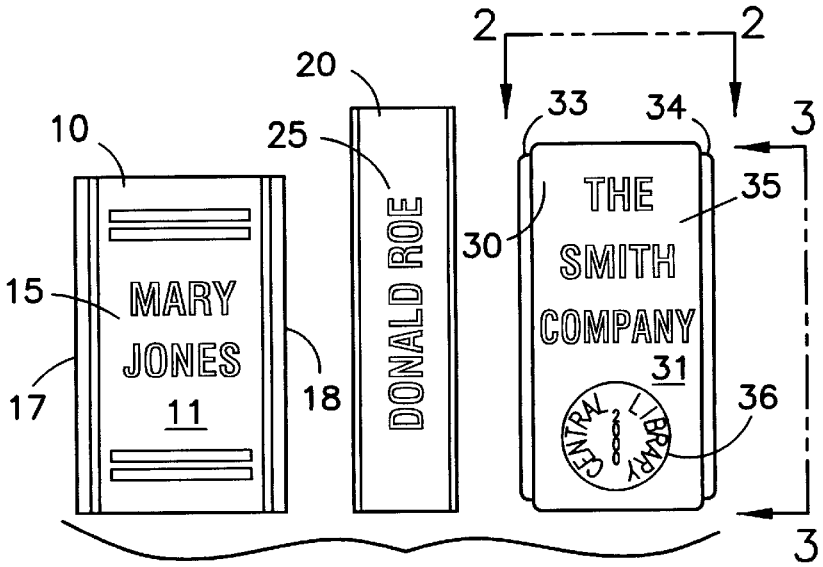
FIG. 1 is an end elevational view of three book tiles in accordance with a preferred embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The inventions includes any alterations and further modifications in the illustrated devices and described methods and further applications of the principles of the invention which would normally occur to one skilled in the art to which the invention relates.

A number of commemorative book tiles 10, 20 and 30 are depicted in FIG. 1. Each of the book tiles bears a representation of the spine of a book. For example, tile 10 includes a spine surface 11 that is decorated to give the appearance of the spine of a classic novel. The tile 10 also carries the name of a donor 15. The size, color and font of the name, as well as the configuration of the spine face 11, can be designed to meet the needs of the donee organization, or to fit the individual personality of the donor whose name is carried on the tile 10. In addition, the side edges 17 of the tile 10 can be slightly curved or uneven to simulate a particular type of bookbinding.

In the book tile 10 the name is arranged horizontally across the spine face 11. Alternatively, the name can be arranged vertically such as the name 25 on book tile 20.

The book 30 shows a further variation of the book spine configuration. In this instance, the donor name 35 is a particular company. This name can be embossed or printed on the spine face 31, again according to the individual or donee design criteria. The sides 34 and 35 of the spine face 31 can have a further configuration, again corresponding to a particular type of bookbinding.

In another feature of the commemorative book tile 30 shown in FIG. 1, a medallion 36 can also be incorporated on the spine face 31. This medallion 36 can carry special indicia to more particularly identify the donor listed in the name 35. For instance the medallion 36 can identify the year of the donation, the donee organization, and/or the particular level or dollar amount of the donation.

Figure 3:
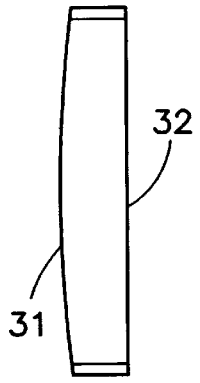
FIG. 3 is a side elevational view of a book tile depicted in FIG. 1.
Figure 2:
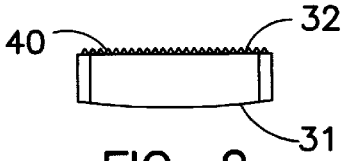
FIG. 2 is a top elevational view of a book tile depicted in FIG. 1.

As shown in the top and side views of FIGS. 2 and 3, of book 30, the spine face 31 can exhibit a special three-dimensional curvature. Again, this curvature can simulate the spine of an actual book, or can be individualized for the donee or donor.

In the most preferred embodiment, the commemorative book tiles are formed of ceramic. Ceramic material is preferred because of its ease of fabrication and low cost. Of course, other materials for the tiles 10, 20 and 30 are contemplated. Again, the particular material can also be individualized to the donor or donee.

Figure 4:
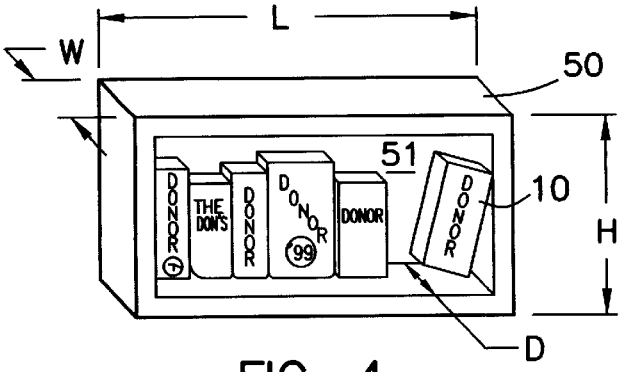
FIG. 4 is a perspective view of a frame for housing book tiles in accordance with one embodiment of the present invention.

Referring to FIG. 4, the invention further contemplates a frame 60 within which a row of commemorative book tiles can be mounted. In a preferred embodiment, the frame 50 is formed of wood to simulate a shelf of a library bookshelf. Each of the tiles preferably includes a mounting material, such as an adhesive 40 depicted in FIG. 2, configured for attaching the tile to an inner wall 51 of the frame. In the most preferred embodiment, the attachment material 40 is an adhesive capable of adhering ceramic to wood. Of course, if the material of either the tile or the frame is altered a different adhesive would be contemplated.

As depicted in FIG. 4, a decorative arrangement of book tiles can be mounted within the frame 50. Each of the tiles carries the name of a donor individual or company. The arrangement of the commemorative book tiles, such as tile 10, in the frame 50 can simulate the normal arrangement of books in a library bookshelf. Alternative, the frame can be filled side-to-side with book tiles of varying widths.

Figure 5:
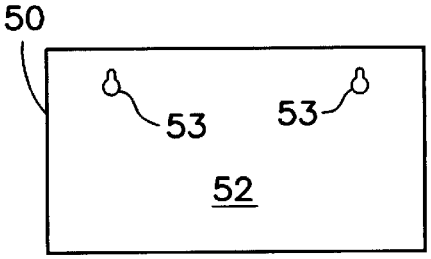
FIG. 5 is a back elevational view of the rear wall of the frame shown in FIG. 4.

In one embodiment of the invention, the frame 50 is configured to be mounted on a wall. Thus, as shown in FIG. 5, the back wall 52 of the frame 50 can include wall-mounting elements, such as elements 53. In the illustrated embodiment, the elements 53 constitutes cutouts in the back wall 52 of the frame that are configured to receive the head of a mounting screw, such as molly bolt, engaged in wall. Alternatively, the mounting elements 53 can be other types of wall fasteners, such as one might use to mount a picture to a wall.

In the instance in which the frame 50 is configured for mounting on a wall, the overall dimensions of the frame, namely the height H, width W, and length L, can be appropriately sized. Preferably, the width W is kept to a minimum so that the frame 50 does not project any farther from the wall than a normal picture would. The length and height of the frame 50 can be dictated by the height of the simulated book spines, and the number of book tiles 10 mounted within the frame. The combined weight of the frame and tiles can be minimized by proper selection of materials, or can be accounted for by the wall mounting technique.

The depth D of the frame 50 corresponds to the distance from the front face of the frame to the inner wall 51 onto which each book tile is mounted. Preferably each book tile has a moderate thickness, on the order of a standard floor tile. In a specific embodiment, the book tiles have a thickness of about 0.25–0.50 inches. In order that the frame 50 accurately simulates a shelf of a bookshelf, the depth D is calibrated according to the thickness of the book tiles. In one specific embodiment, the depth D can be twice the tile thickness, or in the most specific embodiment, about 0.5–1.0 inches. In the instance in which the frame 50 is mounted on a wall, the depth dimension D can correspond to the width W of the frame less the thickness of the frame material forming the back wall 52. (In this instance, the inner wall 51 and back wall 52 are the same).

Figure 6:
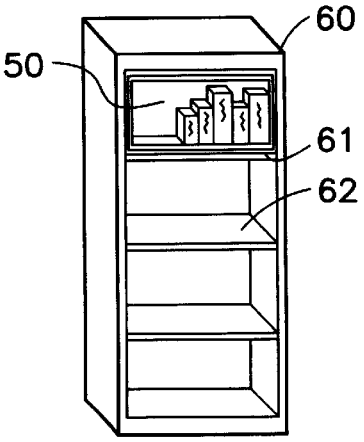
FIG. 6 is a perspective view of a bookshelf incorporating a frame and commemorative book tiles as depicted in FIG. 4.

In a further embodiment of the invention, the frame 50 is configured to be mounted within the shelf of a bookshelf 60, as depicted in FIG. 6. More specifically, the bookshelf 60 can include a number of shelves, such as shelves 61 and 62. The frame 50 can be sized to fit snugly within the shelf 61. In this instance, the interior dimensions of the shelf 61 dictate the height and length. Moreover, the width W of the frame 50 is preferably greater than that of the width for a wall-mounted frame, in order to increase the stability of the frame 50 within the shelf 61. In a preferred embodiment, the frame 50 can have a width of 4.0–5.0 inches for mounting within the shelf 61 of the bookshelf 60.

In one specific use, each shelf of the bookshelf 60, such as vacant shelf 62, can house a frame 50 with a number of commemorative book tiles 10 mounted therein. Alternatively, only one of the shelves can carry the inventive frame and book tiles while the remaining shelves store standard library books.

With the embodiment of FIG. 6, the commemorative book tiles can be displayed at a variety of locations throughout the donee library or establishment. This approach can increase the visibility of the commemorative tiles. In addition, the location of a set of commemorative tiles can be dictated by the specifics of the bookshelf location. For instance, if a number of artists donate to a library, the frame and commemorative tiles for these artists can be mounted in a bookshelf storing books about art and other artists.

While the frame 50 in its most preferred embodiment is configured to be for a wall mounting, and in a second embodiment for placement within a bookshelf, other configurations of the frame can permit placement on any horizontal surface, such as a library table. The present invention provides a great degree of versatility in its application. One object of the invention is to improve the visibility and recognition for the individual donors. The book tiles in 10, 20 and 30 and the frame 50 achieve this objective.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A system for recognizing the names of donors to an establishment, comprising:

a plurality of tiles, one for each of the donors to be recognized, each of said tiles having the appearance of the spine of a book and each bearing the name of a particular donor;

a frame for supporting said plurality of tiles; and means for mounting said tiles to said frame.

2. The system according to claim 1, wherein each of said plurality of tiles is formed of a ceramic material.

3. The system according to claim 1, wherein said frame is formed of wood.

4. The system according to claim 1, wherein each of said tiles is configured to simulate different book spine appearances.

5. The system according to claim 1, wherein:

each of said tiles has a thickness; and said frame includes an inner wall onto which said tiles are mounted, said inner wall being offset a depth from a front face of the frame, wherein said depth is greater than said thickness.

6. The system according to claim 1, wherein said frame includes means for mounting said frame on a wall of a structure.

7. The system according to claim 1, wherein said frame is sized to fit snugly within a shelf of a bookshelf.

8. The system according to claim 1, wherein two or more rows of said plurality of tiles is mounted on said frame.

* * * * *